US005403199A

United States Patent [19]

Mobley et al.

[11] Patent Number: 5,403,199

[45] Date of Patent: Apr. 4, 1995

[54] LOW INSERTION FORCE HIGH CURRENT TERMINAL

[75] Inventors: Dewey Mobley, Lake Orion; James P. Burgess, Troy; Frank R. VanWulfen, Jr., Lathrup Village, all of Mich.

[73] Assignee: Electrical Mechanical Products Inc., Troy; Chrysler Corp., Highland Park, both of Mich.

[21] Appl. No.: 138,971

[22] Filed: Oct. 21, 1993

[51] Int. Cl.[6] ..... H01R 13/627

[52] U.S. Cl. ..... 439/357; 439/350

[58] Field of Search ..... 439/350, 351, 352, 353–358, 439/851, 852

[56] References Cited

U.S. PATENT DOCUMENTS

| | | | |
|---|---|---|---|
| 4,449,776 | 5/1984 | Carmo et al. | 439/350 |
| 4,639,061 | 1/1987 | Muzslay | 439/357 |
| 4,657,335 | 4/1987 | Koch et al. | 339/256 R |
| 4,867,699 | 9/1989 | Oda et al. | 439/355 |
| 4,915,643 | 4/1990 | Samejima et al. | 439/357 |
| 4,925,398 | 5/1990 | Samejima et al. | 439/357 |
| 5,120,234 | 6/1992 | Mergless | 439/357 |
| 5,154,626 | 10/1992 | Watson | 439/268 |

*Primary Examiner*—Larry I. Schwartz
*Assistant Examiner*—Hien D. Vu
*Attorney, Agent, or Firm*—Gifford, Krass, Groh, Sprinkle, Patmore, Anderson & Citkowski

[57] ABSTRACT

A low insertion force, high current connector terminal for vehicular applications. The terminal includes a receptacle connector member having means for varying the inside diameter of a socket thereof, and a pin connector member insertable therein. The receptacle connector member includes an outboardly displaceable resilient finger having a first stop surface engageable with a second stop surface formed on the pin connector member to prevent accidental axial displacement of the two connector members. A slot and mating guide are disposed on, respectively, the receptacle connector member and the pin connector member, said slot and guide serving as both a guide means when the members are connected and also as an indexing means to prevent the connection of two non-mating connector members.

6 Claims, 2 Drawing Sheets

LOW INSERTION FORCE HIGH CURRENT TERMINAL

FIELD OF THE INVENTION

The present invention relates to the field of radially resilient connector terminals and, more particularly, to such a terminal for use in various high current applications.

BACKGROUND OF THE INVENTION

Vehicular wiring systems have become increasingly complicated in recent years, due both to the proliferation of various electrically operated options on vehicles, and also to the increasing sophistication of electromechanical devices. Many of the connector terminals used in the automotive field must be capable of withstanding heavy current loads, such as the heavy output cables connecting generators, alternators and batteries. Moreover, anticipated reintroduction of electric powered vehicles to the marketplace will require even more heavy duty current connectors. Of course, the "under the hood" environment in which these connector terminals are employed puts a great deal of both mechanical and thermal stress on the connections, themselves. Hence, the mating members of electrical connectors of this type must be held together with a firm grip so that the connection does not fail during normal usage. Additionally, these connections must be relatively easy to make; that is, it is highly desirable that one member of the connector terminal be readily insertable into its mating member. The connectors also must be heavy duty to withstand the high current loads, and must also provide adequate electrical contact between the prong and the socket. It is also important that members of a connector pair be uniquely matable so as to prevent the inadvertent misconnection of non-corresponding electrical terminals, an event which could lead to fire, injury or other severe damage in a high-current system.

One class of electrical connector which has evolved in recent years is known as a low insertion force connector. One familiar type of such connector is called a zero insertion force connector. These connectors are particularly useful in applications where the electrical connectors need to be repeatedly coupled and decoupled, such as in vehicular uses. The low insertion force connectors, while utilizing spring loaded contacts in one or both member, s of the mating pairs, have provisions wherein the contact pressure may be temporarily withheld during coupling or decoupling. In particular, a spring loaded female receptacle which engages a solid pin member has provisions inside its socket for temporarily enlarging its effective inside diameter; thus, it will readily disengage the pin during insertion or removal.

An example of such a low insertion force connector is shown in U.S. Pat. No. 5,154,626 wherein the means for temporarily enlarging the socket diameter includes a double helix having two interleaved, helical coils formed into an integral link or loop transversing the coils diametrically and connecting them together. The inside diameter of the double helix may be varied by rotationally driving the closed end of the double helix. The resilience of the wire material spring loads the double helix in a manner which provides secure clamping engagement with the mating pin, along with the ability to release the double helix for insertion or removal of the pin by applying torque to the loop end. While this type of low insertion force connector is highly effective in function, it is also mechanically complicated and expensive to produce.

A simpler and less expensive low insertion force connector is described in U.S. Pat. No. 4,657,335 wherein a radially resilient cage is disposed inside the terminal socket, the cage being constructed from a sheet metal stamping. The stamping is made by cutting longitudinal, spaced, parallel slots in a rectangular blank. The slotted blank is then rolled up into cylindrical form, and inserted into the socket after being given a partial twist at the ends so that the slots are helically aligned inside the socket. The low insertion force connector disclosed in the '335 patent has been shown to be an effective, inexpensive and easy to use connector in various applications.

The present invention is to a connector terminal specifically adapted for high current requirements which is particularly easy to couple and decouple, which provides reliable, positive force connection between the terminal members and which ensures the connection of the right leads to the right receptors in the terminal, even in a variety of wiring configurations.

SUMMARY OF THE INVENTION

Disclosed and claimed herein is a low insertion force, high current connector terminal for such high current uses as in the wiring system of a motor vehicle, or with certain machinery. The connector terminal includes both a receptacle connector member and a pin connector member for sliding insertion into the receptacle. The receptacle connector member comprises an electrically non-conductive, cylindrical sleeve including electrically conductive means for varying the inside diameter thereof. A cage defined by an integral side wall is disposed coaxially around the sleeve and is radially displaced therefrom.

The receptacle connector member further includes a resilient finger having a first end disposed thereon and terminating in a second, free end. The finger extends outboard from the cage side wall. The finger has a first stop surface formed on an inner surface thereof and is resiliently displaceable in a radial direction outboard of the sleeve.

An electrical cable is in electrical contact with the electrically connective means of varying the internal diameter of the socket. The electrical cable, typically, is in electrical communication with, for example, the alternator, generator or battery of the motor vehicle. As is conventional, the cable includes electrical insulation disposed therearound.

The pin connector member of the connector terminal of the present invention includes an electrically conductive pin configured for sliding insertion into the sleeve of the receptacle connector member. An electrically non-conductive housing is coaxially disposed around the pin and radially spaced outboard therefrom to form an aperture configured to accommodate said sleeve therein. A guide projects outward from a wall of the housing for sliding engagement with the slotted side wall of the receptacle connector member cage. A second stop surface is formed of the housing for engagement with the first stop surface formed on the resilient finger to prevent axial motion between the receptacle connector member and the pin connector member when the pin connector member is engaged with the receptacle connector member. An electrically conductive lead is in electrical communication with the pin for connection to the electrical system of the motor vehicle.

In a particularly preferred embodiment, the connector terminal cage is rectangular in configuration and includes two pairs of opposed, L-shaped corner members, the base section of one pair of corner members extending toward each other to meet and form an integral side wall. The base sections of the other pair of corner members terminate short of each other to form a slotted side wall. Accordingly, the slotted side wall opposes the integral side wall, with the sleeve disposed in between. In this embodiment, the resilient finger is disposed medial of and outboard from the leg of one of the corner members of the integral side wall and the leg of the opposite corner member of the slotted side wall. To accommodate this configuration of the receptacle connector member cage, the housing of the pin connector member is rectangular in configuration with each of its corners cut away for sliding engagement with the legs formed on the corners of the receptacle cage. Thus, the finger is disposed transverse of both opposed side walls.

BRIEF DESCRIPTION OF THE DRAWINGS

The following detailed description is best understood by reference to the following drawings in which.

DETAILED DESCRIPTION OF THE PREFERRED EMBODIMENTS

Figures 1, 2:
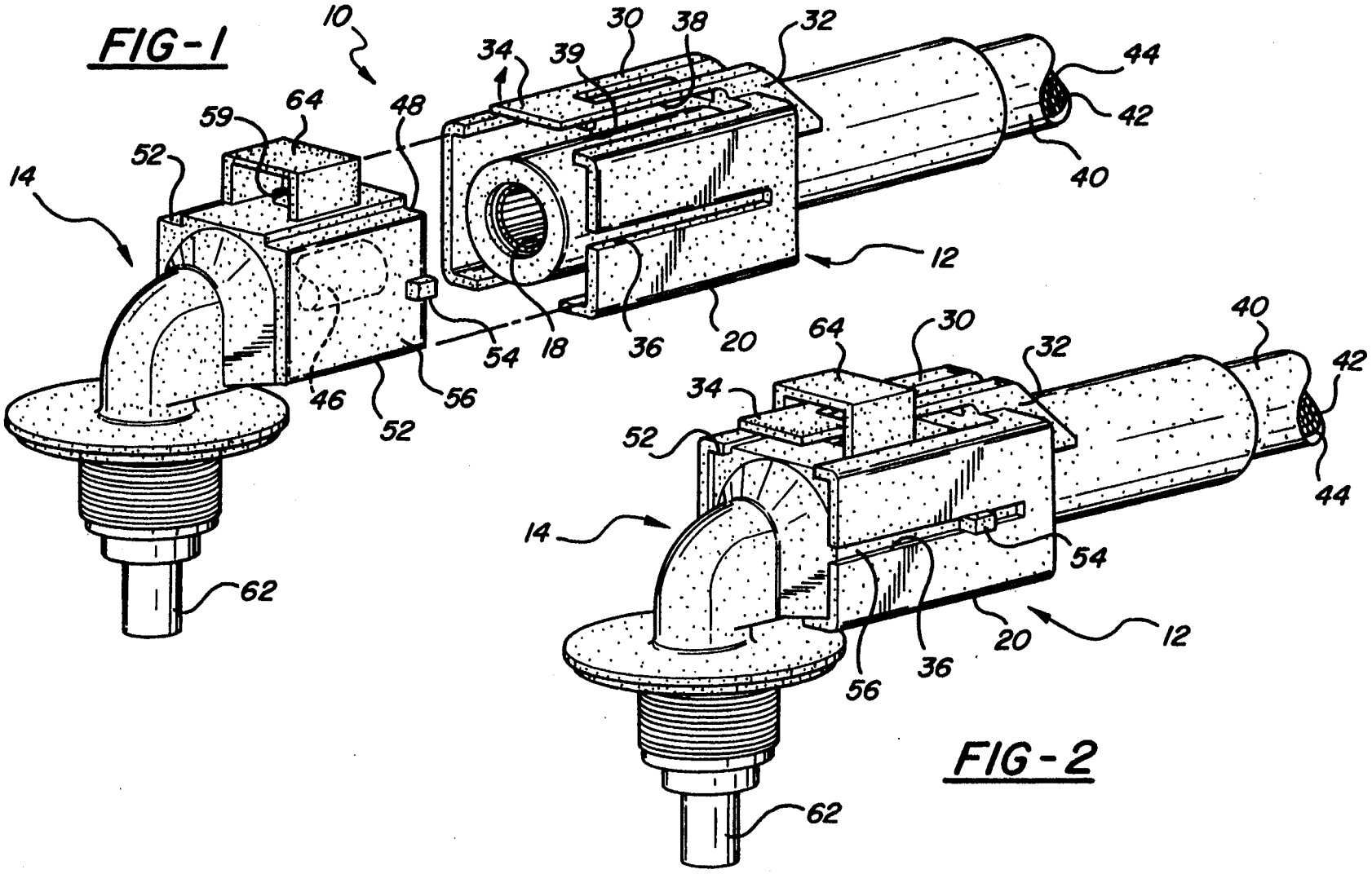
FIG. 1 is a perspective view of a connector terminal according to the present invention with the two elements thereof separated.
FIG. 2 is similar to FIG. 1 but shows the two members connected.

Throughout the following detailed description, like reference numerals are used to refer to the same element of the invention shown in multiple figures thereof. Referring now to the drawings and in particular to FIG. 1, there is shown a connector assembly 10 constructed according to the present invention. The connector assembly 10 is comprised of a receptacle connector member 12 and a pin connector member 14. As is conventional, the receptacle connector member 12 has a socket (FIG. 3) which includes a sleeve 16 formed of electrically nonconductive material and means 18 for varying the internal diameter of the sleeve 16. The means 18 is formed of an electrically conductive material, such as a conductive metal such as is well known and described on pages two and three.

Figure 3:
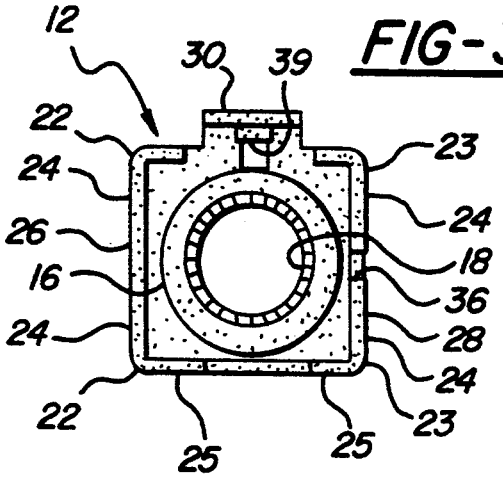
FIG. 3 is a front elevational view of the receptacle connector member of the terminal connection of the present invention.

The arrangement of the non-conductive sleeve 16 and conductive means 18 disposed therein are best seen by reference to FIG. 3 which is a front elevational view of the receptacle connector member 12 of the present invention. As can clearly be seen in FIG. 3, the sleeve 16 is surrounded by a cage 20 comprised of two opposed pair of corner members 22,23. Each of the pairs 22,23 of corner members is in the shape of an L and includes a base 24 and a shorter leg 25 projecting from base 24 at a right angle thereto. The bases 24 of one pair of corner members 22 form integral side wall 26. In contrast, the bases 24 of the other pair 23 of corner members terminate short of each other to form a slotted side wall 28 and a slot 36 medial of the bases 24. Integral side wall 26 opposes slotted side wall 28, and sleeve 16 is disposed therebetween.

A resilient finger 30 (best seen in FIG. 1) has a first end 32 which is disposed on receptacle connector member 12. The resilient finger 30 terminates in a second, free end 34. Finger 30 is disposed on connector member 12 such that it is outboard from and medial of one of the corner members 22 and one of the corner members 23 of, respectively, integral side wall 26 and slotted side wall 28. Disposed on an inner face 38 of resilient finger 30 is a first stop surface 39 which is oriented toward first end 32.

As is conventional in automotive applications, receptacle connector member 12 may further include an electrical cable 40 formed of a plurality of individual wires or wire bundles 42, all of which is sheathed by insulating means 44. Wire bundles 42 are in electrical communication with the electrically conductive means 18 for varying the internal diameter of sleeve 16 which is disposed inside sleeve 16.

Figure 4:
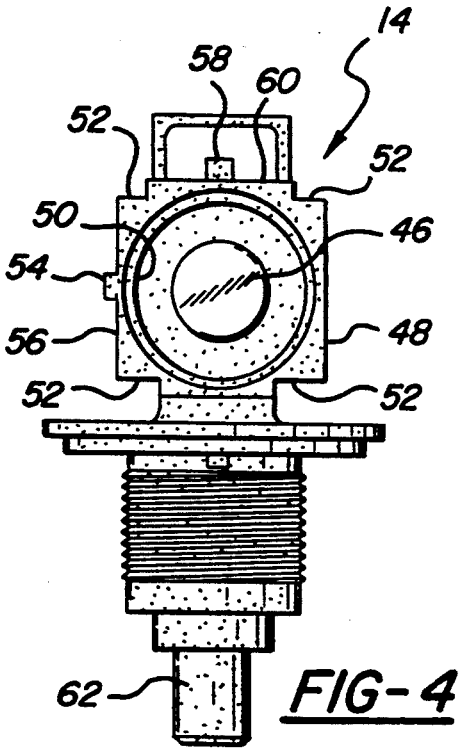
FIG. 4 is a front elevational view of the pin connector member of the connector terminal of the present invention.

Pin connector member 14 includes an electrically conductive pin 46 (best seen in FIG. 4) surrounded by a housing 48. The walls of the housing 48 are spaced from the pin 46 so as to create a ring-shaped aperture 50 for insertion of the sleeve 16 of the receptacle connector member therein. When the two members 12,14 are connected, pin 46 of pin connector member 14 is disposed inside sleeve 16 of receptacle connector member 12.

The corners of housing 48 of pin connector member 14 include cut-away portions 52 for engagement with the L-shaped corner members 22,23 of receptacle connector member 12. A projecting guide 54 is formed on a first side wall 56 of housing 48 for engagement with slot 36 formed in cage 20 of receptacle connector member 12. The guide 54 serves to align and orient receptacle connector member 12 with respect to pin connector member 14 when the two members are being connected, and to assure that only proper pairs of connectors 12,14 are engaged.

A second stop surface 58 is formed on a second side wall 60 of housing 48. Second stop surface 58 is opposed to first stop surface 39 for engagement therewith when the two members 12,14 are connected. As is conventional in automotive applications, pin connector member 14 terminates in an electrically conductive lead 62 which is continuous with or otherwise in electrical communication with electrically conductive pin 46.

Optionally, a small finger cage may be disposed on housing 48 so that it surrounds second stop 58. Finger cage 64 is configured so as to surround and enclose resilient finger 30 of receptacle connector member 12 when the two members 12,14 are in connection. The cage prevents inadvertent disengagement of the finger 30, and it also prevents other wires and like items from being caught under the finger 30.

Preferably, the means for varying the internal diameter of the sleeve is constructed along the lines disclosed in the aforementioned U.S. Pat. No. 4,657,335. Upon insertion of the pin 46 into sleeve 16, the individual longitudinal strips of which the means 18 for varying the inner diameter of sleeve 16 may be comprised (if this type of low insertion force connector is employed) will stretch longitudinally and move radially outwardly toward the inner surface of sleeve 16 a sufficient distance to accommodate the insertion of pin 46. The inner surfaces of the strips will then grip the pin 46 to maintain a firm frictional grip on the pin so as to maintain the mechanical connection despite the mechanical and thermal stresses normal to the under-the-hood environment. However the two members may be easily disconnected.

Insertion of the guide 54 into the slot 36 serves to maintain the members 12,14 in proper alignment when the sleeve 16 of the receptacle connector member 12 is inserted into the aperture 50 of the pin connector member 14. As the members 12,14 are slidingly connected, the inner face 38 of finger 30 will pass over the second side wall 60 of housing 48, and resilient finger 30 will deflect outboardly to permit this passage. After first stop surface 39 has passed second stop surface 58, the first stop surface 39 will engage second stop surface 58, thus preventing accidental and undesirable axial displacement of the members with respect to each other to preserve the integrity of the electrical contacts. The two members 12,14 of the connector are easily disconnected by simply outwardly deflecting resilient finger 30 so as to disengage the two stop surfaces 39,58, thus permitting the withdrawal of receptacle connector member 12.

The sleeve 16 may be advantageously fabricated of a material highly resistent to thermal softening, such as various copper/tellurium alloys. For the means 18 for varying the internal diameter of the sleeve, copper/beryllium alloys possess particularly desirable characteristics; high resiliency and high electrical conductivity. Particularly desirable copper/beryllium alloys for this purpose include CDA 17410 and CDA 174 (CDA refers to the Copper Development Association).

Figure 5A:
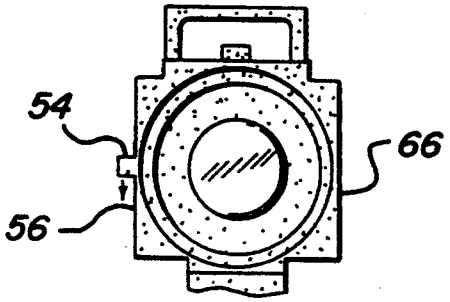
FIGS. 5A–5D are illustrations of various pin connector members according to the present invention showing the guide thereof in different positions for indexing.
Figure 5B:
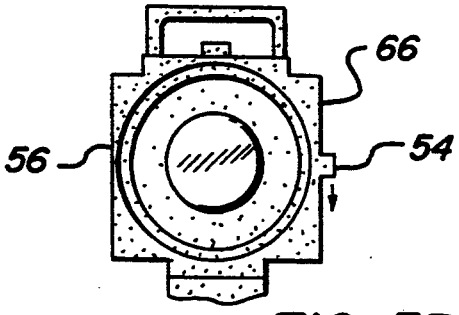
Figure 5C:
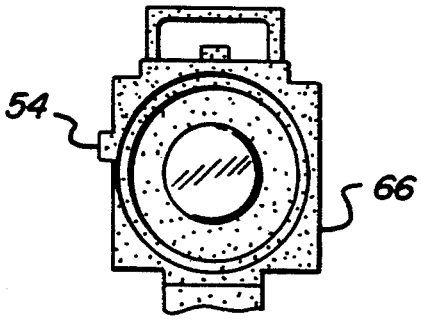
Figure 5D:
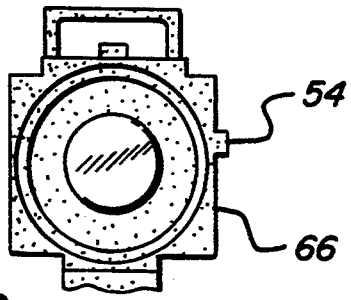

A plurality of the connector terminals of the present invention may be used in the wiring system of a typical vehicle. Moreover, various models having different options may employ these terminal connectors. Hence, the location and exact positioning of the guide 54 may serve as an indexing means; one type of connector terminal may have the guide (and mating slot) disposed on the first side of wall 56 the connector pair, whereas another type may have the guide and slot disposed on the side wall 66 opposite the first side wall 56 so as to prevent the accidental mating of two different types of terminal members. Examples of pin connector members having guide 54 disposed on opposite side walls 56,66 of the housing are shown in FIGS. 5A–5B. Moreover, while the guide and slot shown in FIGS. 1–4 are disposed approximately half way between the corners of the respective housing and cage, these positions may be shifted upwardly or downwardly as desired, again to prevent the accidental assembly of a mismatched pair of terminal connector members. FIGS. 5C and 5D show a pin connector member having the guide displaced upwardly from the center point of the side wall, while FIGS. 5A and 5B show it displaced downwardly.

Thus, while the present invention has been described with respect to certain embodiments and exemplifications thereof, it is not limited solely to those depicted. Other arrangements and designs may occur to one skilled in the art without departing from the scope of the present invention. The present invention is defined solely by the claims appended hereto and all reasonable equivalents thereof.

We claim:

1. A low insertion force, high current connector for use in a wiring system of a vehicle, said connector comprising:

a receptacle connector member including:

a non-conductive sleeve, including an electrically conductive socket having a variable inside diameter disposed in said sleeve;

a cage disposed coaxially around said sleeve and radially spaced therefrom, so as to define integral side walls, one of said side walls including a slotted portion;

a resilient finger having a first end integral from an end of said receptacle member and terminating in a second free end, said finger extending outboard from a back wall of said receptacle member, said finger having a first stop surface depending from an inner surface thereof and being resiliently displaceable in a radial direction outboard of said sleeve;

an electrical cable in electrical contact with said socket of said sleeve;

a pin connector member for sliding insertion into said receptacle member, said pin connector member including:

an electrically conductive pin configured for insertion into said socket;

a housing coaxially disposed around said pin and radially spaced outboard therefrom to define an apeture configured to receive said sleeve;

a guide projecting outwardly from said housing for sliding engagement with said slotted portion of the side wall of said receptacle cage;

a cut away portion at each corner of a top wall of said housing for sliding engagement with said side walls;

a second stop surface formed on said top wall for engagement with said first stop surface on said resilient finger to prevent axial motion between said receptacle connector member and said pin connector member when said pin connector member is engaged with said receptacle connector member; and an electrically conductive lead in electrical communication with said pin for connection to the wiring system of the vehicle, wherein said first and second stop surface may be disengaged by outward deflection of said free end of said resilient finger.

2. The connector of claim 1 further comprising a finger cage disposed on said housing so as to surround said second stop surface, said finger cage being configured to receive the free end of said resilient finger therein when said pin connector member is engaged with said receptacle connector member to prevent accidental disengagement of said first and second surfaces.

3. The connector of claim 1 wherein the sleeve is formed of a copper/tellurium alloy and the socket is formed of copper/beryllium alloy.

4. A low insertion force, high current connector for use in an electrical system of a vehicle, said connector comprising:

a receptacle connector member including:

a cylindrical sleeve, including an electrically conductive socket having a variable inside diameter, disposed in said sleeve wherein said socket is in electrical communication with the electrical system of the vehicle;

a cage disposed coaxially around said sleeve and radially spaced therefrom, said cage including two pairs of opposed, corner members, each corner member having a pair of L-shaped portions and each said L-shaped portion including a base section and a leg projecting perpendicularly therefrom, the base sections of one pair of said L-shaped portions forming an integral side wall, and the base sections of the other pair of said L-shaped portions terminating short of each other to form slotted side wall opposed to said integral side wall;

a resilient finger having a first end integral from an end of said receptacle connector member and terminating in a second free end, said finger extending medial of and outboard from a back wall of said receptacle member, said finger being between the legs of the corner members, said finger having a first stop surface formed on an inner surface thereof and being resiliently displaceable in a radial direction outboard of said sleeve; and a pin connector member for sliding insertion into said receptacle connector member, said pin connector member including:

an electrically conductive pin configured for insertion into said socket and in electrical communication with the electrical system of said vehicle;

a rectangular housing coaxially disposed around said pin and radially spaced outboard therefrom to define a ring-shaped aperture configured to receive said sleeve;

a cut-away portion at each corner positioned on a top wall of said housing for sliding engagement with the legs of the receptacle cage;

a guide projecting to extend outwardly from a first side wall of said housing for sliding engagement with said slotted side wall of said receptacle cage; and a second stop surface formed on said top wall of said housing for engagement with said first stop surface of said resilient finger to prevent axial motion between said receptacle connector member and said pin connector member when said pin connector member is engaged with said receptacle connector member.

5. The connector of claim 3, further including a finger cage disposed on the top wall of said housing, said finger cage configured to receive and surround the free end and second stop surface of said finger when said pin connector member is engaged with said receptacle connector member.

6. The connector of claim 4 wherein the sleeve is formed of a copper/tellurium alloy and the socket is formed of a copper/beryllium alloy.

* * * * *